US005429054A

United States Patent [19]

Topping

[11] Patent Number: 5,429,054

[45] Date of Patent: Jul. 4, 1995

[54] TRACER CARTRIDGES

[76] Inventor: Richard E. Topping, 14 Knowle Close, Langton Green, Tunbridge Wells, Kent TN3 0EP, Great Britain

[21] Appl. No.: 105,496

[22] Filed: Feb. 18, 1993

[30] Foreign Application Priority Data

Apr. 18, 1991 [GB] United Kingdom ..... 9108310

[51] Int. Cl.[6] ..... F42B 7/08

[52] U.S. Cl. ..... 102/458; 102/451; 102/532

[58] Field of Search ..... 102/448, 449, 450, 451, 102/453, 458, 461, 513, 515, 523, 532

[56] References Cited

U.S. PATENT DOCUMENTS

| | | | |
|---|---|---|---|
| 1,457,337 | 6/1923 | Barrows | 102/458 |
| 1,887,989 | 11/1932 | Browndsdon et al. | 102/458 |
| 1,887,990 | 11/1932 | Brownsdon et al. | 102/458 |
| 3,262,390 | 7/1966 | Cowles et al. | 102/458 |
| 3,368,489 | 2/1968 | Herter | 102/450 |
| 3,405,638 | 10/1968 | Stoner, Jr. | 102/458 |
| 3,420,178 | 1/1969 | Rempel | 102/450 |
| 3,935,816 | 2/1976 | Boquette, Jr. | 102/515 |
| 4,389,939 | 6/1983 | Ofuji | 102/458 |
| 4,553,481 | 11/1985 | Ricci | 102/458 |
| 4,841,866 | 1/1989 | Miesner | 102/458 |
| 5,105,744 | 3/1992 | Petrovich | 102/515 |

*Primary Examiner*—Harold J. Tudor
*Attorney, Agent, or Firm*—Harold Gell

[57] ABSTRACT

A tracer wad for a cartridge comprises a shot holder consisting of four quadrants defining between them a tubular member, a tracer element holder and a conical recess leading to a bore for directing ignited propellant onto a tracer element held in the holder to ensure reliable ignition of the tracer element on firing of the cartridge. A flexible skirt portion ensures a good gas seal between the wad and the barrel of a firearm when the cartridge is fired. When the wad leaves the barrel, the quadrants are peeled back and the tracer element leaves the holder to follow the trajectory of the shot.

14 Claims, 7 Drawing Sheets

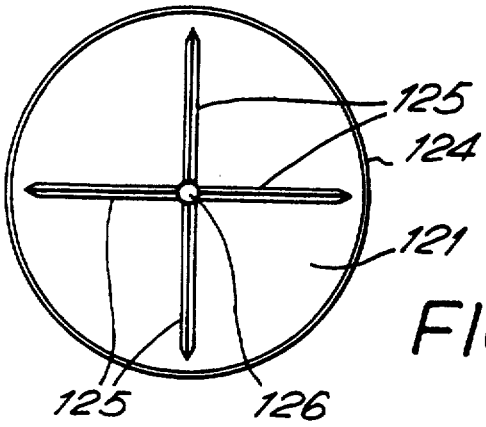
FIG.12.
FIG.15.
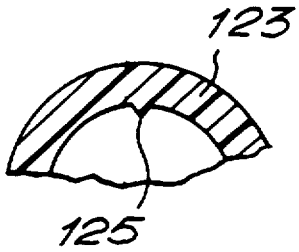
FIG.13.
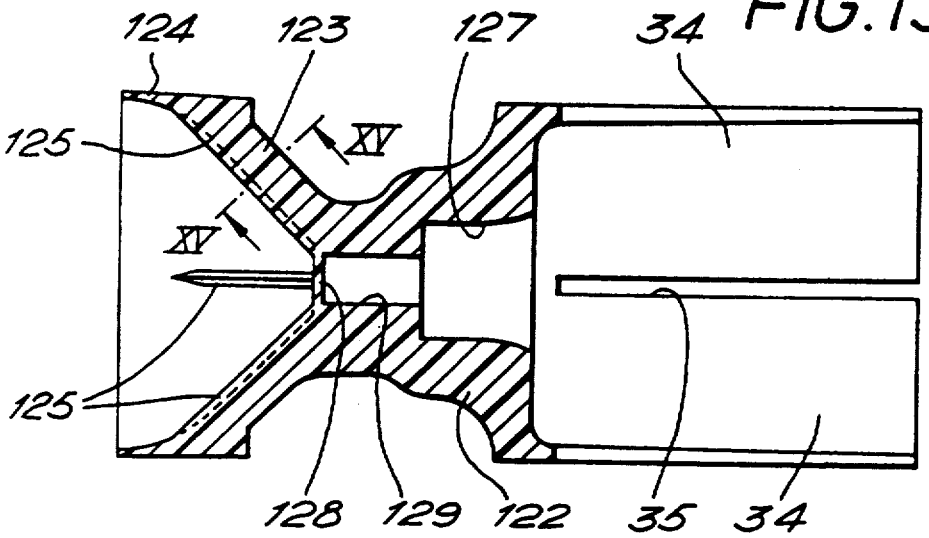
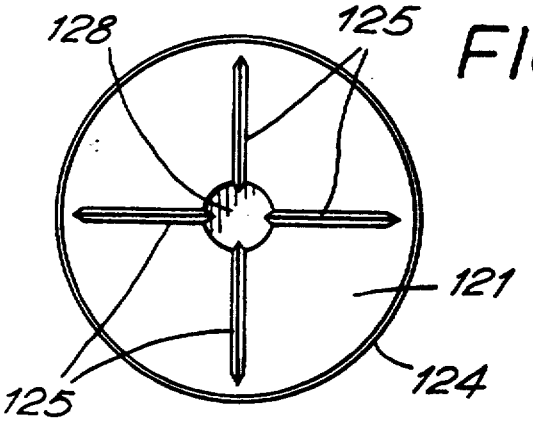
FIG.14.
FIG.15A.
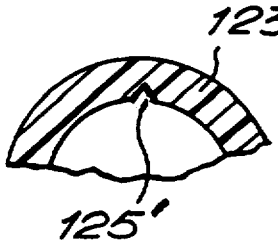

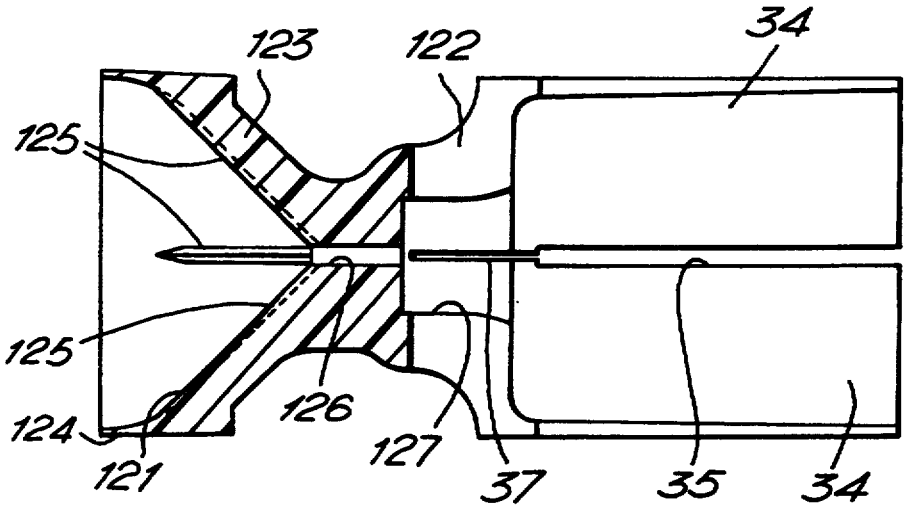
FIG.16.
FIG.17
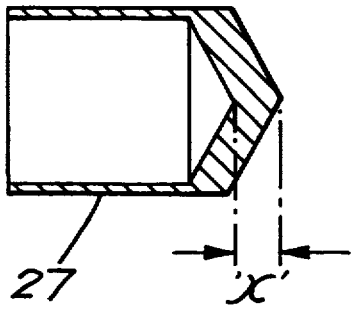
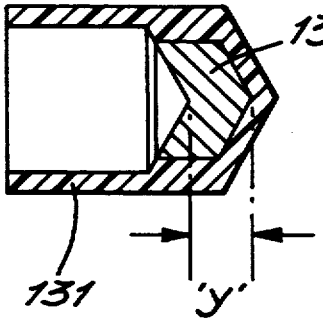
FIG.18.
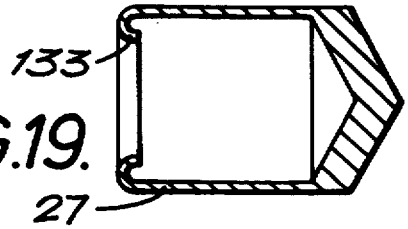
FIG.19.

TRACER CARTRIDGES

This is a continuation of International Application PCT/GB92/00565, filed May 27, 1992, which designated the United States and is now abandoned.

This invention relates to improvements in tracer cartridges and is particularly concerned with wads for holding tracer elements in such cartridges. The invention is primarily concerned with, but is not restricted to, cartridges for smooth bore weapons such as shotguns.

A tracer cartridge is a type of cartridge which has an incendiary, light emitting, portion. The incendiary portion burns brightly when the cartridge is fired. This can be observed by the firer and indicates the path or trajectory of the lead shot.

A longitudinal cross-sectional view of a typical shotgun tracer cartridge of the prior art is shown in FIG. 1 of the drawings. The shotgun tracer cartridge comprises a cartridge casing 100 having a percussion cap 102 at its closed end. The casing 100 also contains propellant 104 adjacent the percussion cap 102. An over powder wad 106, having a central flash hole 108, packs the propellant 104. Located adjacent to the over powder wad 106 is a tracer wad 110. The tracer wad 110 has a central tracer element 112 aligned with the flash hole 108. A tracer retention disc 114 holds the tracer wad 110 in place and separates the tracer wad 110 from lead shot 116. A cartridge turnover 118 seals the shot 116 in the casing 100.

In use, the cartridge is inserted in the barrel of a shotgun and when the trigger is pulled, the firing pin or hammer is effective to strike the percussion cap 102 which then ignites the propellant 104. The propellant 104 burns and flames pass through the flash hole 108 to ignite the tracer element 112. Gas pressure in the casing 100 increases until the cartridge turnover 118 is peeled back. The wad 106, wad 110 and tracer element 112, disc 114 and shot 116 then exit the casing 100, travel along the barrel and exit the muzzle, typically at approximately 335 m/sec. (1100 feet per second).

The tracer element 112 has a lower mass to frontal area ratio than the tracer wad 110 and so eases itself out of the tracer wad 110. The tracer element 112 then pursues a ballistic trajectory, leaving the tracer wad 110 behind. However, the degree of tightness/looseness of the fit between the tracer element 112 and the tracer wad 110 will determine how much the tracer element 112 is decelerated whilst leaving the wad 110. Further, if there is any angular offset of the tracer wad 110 as it exits the muzzle, this will also affect the disengagement of the tracer element 112 from the tracer wad 110. Moreover, as a result of the wad being compressed too much during firing, the fit between the tracer element 112 and the wad 110 may be so tight that the tracer element 112 does not leave the wad 110 at all.

The above factors will affect the velocity of the tracer element 112 and hence its ability to match the velocity and trajectory of the lead shot 116.

The tracer element contained within the known cartridge above described had a fixed mass by the nature of the lead shot 116 being of a fixed size and therefore weight so that it was not possible to vary the trajectory of the tracer element.

The prior art tracer element also had only one fixed amount of tracer composition and therefore fixed light emitting time.

The wads 110 and 106 were produced from fibrous materials which did not afford an effective gas seal on the outside of the wad or around the tracer element. Standard, non-tracer cartridges also have fibre wads, giving the same gas sealing problems.

In an attempt to reduce the wad-to-barrel sealing problem, plastic moulded wads were introduced some years ago. Plastic wads allow the production of a 'cup' that holds the lead shot preventing its abrasion against the barrel wall and thereby reducing wear of the barrel wall.

Most shotguns have a parallel internal smooth bore with the ability to insert, at the muzzle end, a short length of barrel which is less in diameter than the bore. This short length is known as a 'choke' whose object is to reduce the spread of shot after exit from the muzzle.

A plastic wad must be of a diameter that provides a good gas seal during passage along the barrel, but must have no difficulty passing through the smaller diameter choke.

The present invention aims to provide a wad for a tracer cartridge which eliminates or at least substantially reduces the above-mentioned disadvantages of conventional tracer cartridges.

According to the invention, there is provided a tracer wad for a cartridge, said tracer wad comprising a shot holder, a tracer element holder and means for directing ignited propellant onto a tracer element held in the holder to ensure reliable ignition of the tracer element on firing of the cartridge, the tracer element holder being adapted to release the tracer element when the wad leaves the barrel of a firearm on firing of the cartridge.

According to one embodiment of the invention, the shot holder, the tracer element holder and the propellant directing means are formed as an integral unitary component.

The propellant directing means may comprise a conical recess formed in an end of the tracer wad which is remote from the shot holder. One or more ridges or grooves is/are desirably formed in the surface of the conical recess and the narrow end of the recess desirably communicates with the tracer element holder via a small bore formed in the tracer wad. The bore may be closed by a frangible diaphragm which is designed to rupture when a cartridge containing the tracer wad is fired.

In this embodiment, the end of the tracer wad remote from the shot holder is preferably provided with a flexible skirt portion which is adapted to engage the barrel of a firearm during firing to provide a gas seal and prevent the escape of gas past the wad. The skirt portion may be connected to the shot holder of the tracer wad by a crush zone.

According to another embodiment of the invention, the propellant directing means comprise a tapered bore leading from the propellant through the tracer element holder to the tracer element to funnel ignited propellant onto the element. The bore may be curved and, according to a preferred embodiment, the wall of said bore is curved in a sinusoidal manner.

Preferably, the wall of the tapered bore is provided with a series of ribs or ridges or with a series of grooves extending substantially in the axial direction of the tapered bore.

Alternatively, the propellant directing means may comprise a profiled wall for directing ignited propellant onto a tracer element held in the tracer element holder.

The profiled wall is desirably sinusoidal in cross-section and a series of ribs or grooves are preferably provided on or in said wall.

The tracer wad according to the invention preferably includes a crush zone which may be located around or formed integrally with the tracer element holder. If the crush zone is formed separately from the tracer element holder, it may take the form of resilient compression members or a soft, fibrous, tubular member. Alternatively, the crush zone may be formed by providing a series of grooves in the outer wall of the tracer element holder, said grooves defining a number of annular ridges or ribs therebetween.

The shot holder has a side wall which is preferably divided by slots into quadrants. Said slots may extend down into the tracer element holder.

The invention also extends to tracer elements for use in the tracer wad according to the invention. In one form, the tracer element comprises a metal casing which is open at one end for receiving incendiary material, the other end of the element being profiled for minimum air resistance and the mass of the element being adjustable by varying the thickness of its profiled end. Alternatively, the tracer element may be moulded from a plastics material and adapted to receive a plug of metal, the mass of the element being adjustable by varying the mass of the metal plug.

The invention will now be described in detail, by way of example, with reference to the drawings, in which:

FIG. 12 is an end view of the tracer wad shown in FIG. 11;

FIG. 13 is a longitudinal cross-sectional view of an alternative tracer wad for use in the cartridge shown in FIG. 11;

FIG. 14 is an end view of the tracer wad shown in FIG. 13;

FIG. 15 shows a cross-section taken on the line XV—XV in FIG. 13 in the direction of the arrows;

FIG. 15A shows a cross-section taken along the line XV—XV in FIG. 13 in the direction of the arrows;

FIG. 16 is a longitudinal cross-sectional view of a further alternative tracer wad for use in the cartridge shown in FIG. 11;

FIGS. 17 and 18 are longitudinal cross-sections through two different embodiments of tracer elements for use in the wad according to the invention; and FIG. 19 is a longitudinal cross-section through a modification of the tracer element shown in FIG. 17.

In the drawings, like parts are denoted by like reference numerals.

Figure 1:
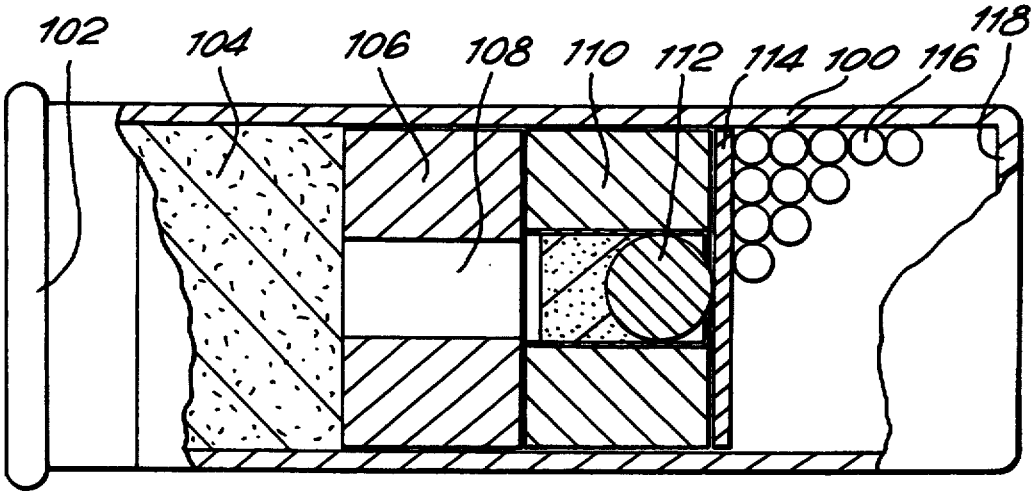
FIG. 1 is a longitudinal cross-sectional view of a tracer cartridge of the prior art.
Figure 2:
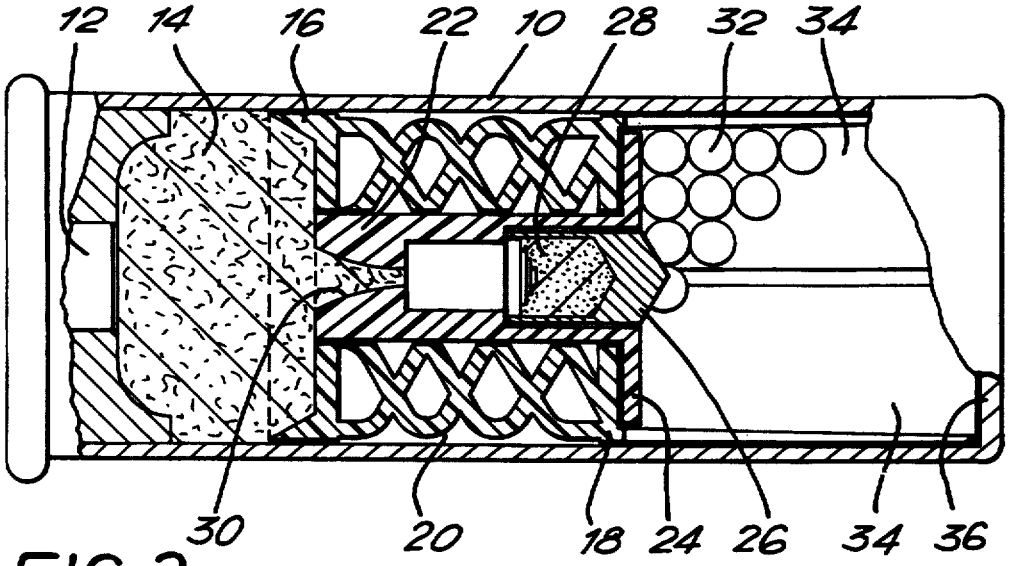
FIG. 2 is a longitudinal cross-sectional view of a tracer cartridge fitted with one embodiment of a wad according to the present invention.

Reference will first be made to FIG. 2 of the drawings in which the tracer cartridge comprises a cartridge casing 10 having a percussion cap 12 located at its closed end. A propellant charge 14 is contained within the casing 10 adjacent the percussion cap 12. A tracer wad having a cup shaped base 16 is located within the casing 10 and is arranged to locate the propellant 14. The base 16 is connected to the base of a shot holder 18 by a tubular section 20 which constitutes a crush zone as will be hereinafter described. The tubular section 20 defines a bore which is adapted to receive and hold a tracer element holder 22 having a flanged base 24 designed to butt against the base of the shot holder 18. The holder 22 has a stepped bore the larger diameter portion of which is located adjacent to the base 24 and is adapted to receive a tracer element 26.

The tracer element 26 is a fairly loose fit in the stepped bore in the holder 22 to allow it to leave the bore easily when the cartridge is fired. The tracer element takes the form of a casing made from a suitable material such as copper or steel or possibly even lead having a tapered end or a part-spherical end (not shown) and a bore which is packed with incendiary material 28.

Leading from the narrow end of the stepped bore in the holder 22 is a tapered funnel-shaped bore 30 which opens out towards the base 16 of the wad. This bore 30 is also filled with the propellant charge 14.

The shot holder 18 contains projectiles in the form of lead shot 32 within its walls 34. These walls are desirably formed in a number of arcs, typically four equal arcs each of 90°. The casing 10 has a turnover 36 at its open end to hold the shot within the cartridge.

The crush zone formed by the tubular section 20 comprises a series of resilient compression members located between the base 16 and the base of the shot holder 18 and attached thereto. The compression members may, if desired, be formed integrally with the bases 16 and 18 by forming these components from a suitable plastics material.

On being struck by a firing pin, the percussion cap 12 ignites the propellant 14 and a flame/pressure front progresses through the propellant. When the flame/pressure front reaches the tapered bore 30 it is funnelled up the bore and directed at high pressure onto the incendiary material 28 of the tracer element 26 to ignite the same. At the same time, the crush zone is compressed and exerts a force through the base of the shot holder 18 and the lead shot 32 onto the turnover 36 until resistance is overcome and the wad and shot are ejected from the casing 10.

The shot is contained within the walls 34 of the shot holder until the wad exits from the barrel of the gun which is being fired. The four arcs of the walls 34 of the shot holder are then peeled back by wind pressure thus freeing the shot and, at the same time, decelerating the wad. This deceleration allows the ignited tracer element 26, by virtue of its loose fit in the stepped bore in the holder 22, to eject from the holder and to follow the lead shot 34.

As the wad, tracer element and shot accelerate along the gun barrel, the skirt of the tracer element sits on the shoulder formed between the two bores of the stepped bore in the holder 22 providing an effective gas seal between the burning propellant and the outside atmosphere in the barrel.

Figure 3:
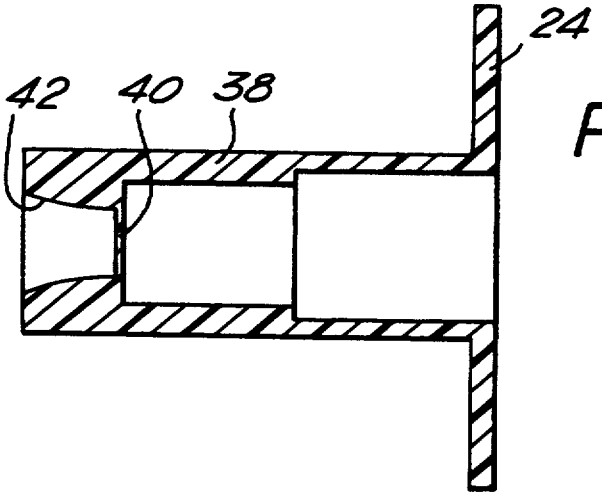
FIG. 3 is a longitudinal cross-sectional view of an alternative tracer element holder for use in the wad shown in FIG. 2.

FIG. 3 shows another embodiment of a tracer element holder 38 suitable for use in the cartridge shown in FIG. 2. As shown in FIG. 3, the narrow end of the stepped bore in the holder 38 is closed by a membrane 40 which is designed to rupture when hit by the flame/-pressure front of ignited propellant. In this case, the tapered bore 42 does not have such a pronounced taper or curvature as the tapered bore 30 in the embodiment shown in FIG. 2 of the drawings.

Figure 4:
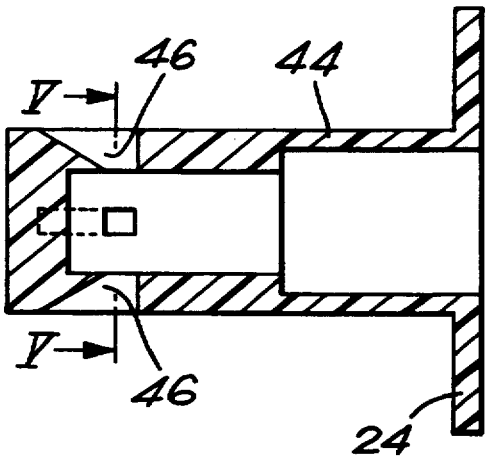
FIG. 4 is a longitudinal cross-sectional view of a further alternative tracer element holder for use in the wad shown in FIG. 2.
Figure 5:
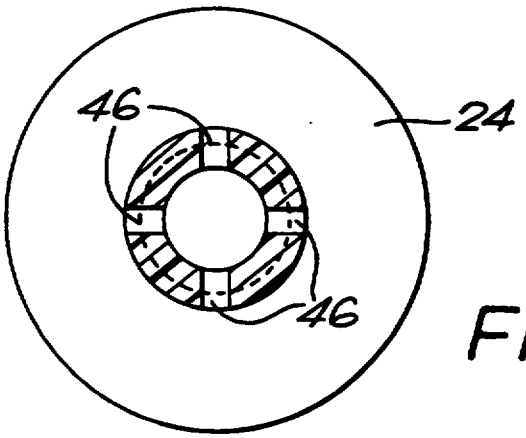
FIG. 5 is a section taken on the line V—V in FIG. 4.

In the embodiment shown in FIGS. 4 and 5 of the drawings, a series of tapered cross bores 46 are provided in the wall of the holder 44 and lead into the narrow end of the stepped bore in the holder.

Preferably, four such cross bores 46, spaced apart by 90° as shown in FIG. 5, are provided. This holder may equally be used in the cartridge shown in FIG. 2 of the drawings.

Figure 6:
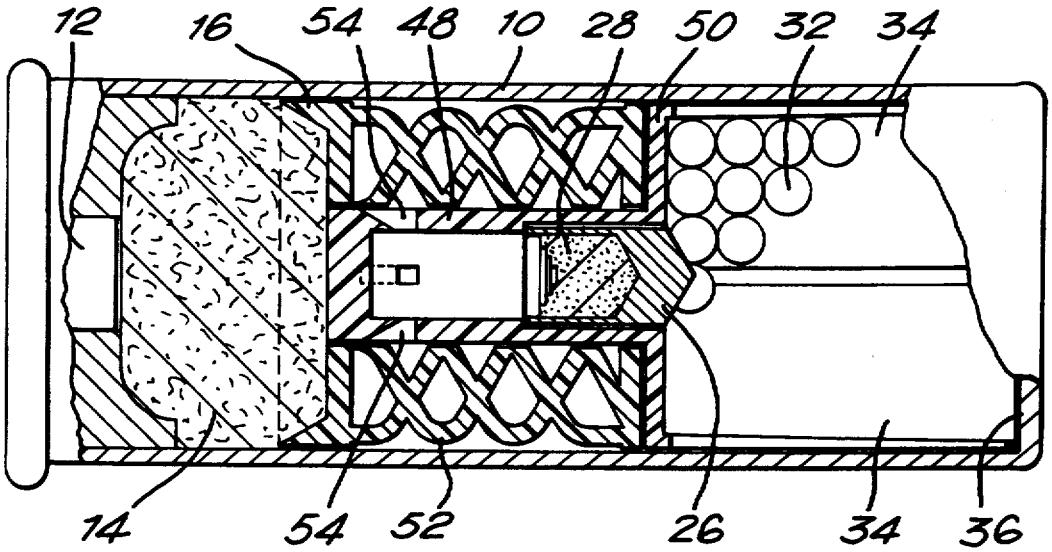
FIG. 6 is a longitudinal cross-sectional view of a tracer cartridge fitted with another embodiment of a wad according to the invention.

Turning now to FIG. 6 of the drawings, in this embodiment the tracer element holder 48 is attached to the shot holder. The latter has a base 50 from which the holder 48 extends in one direction and the walls 34 extend in the opposite direction. A tubular section 52 constituting a crush zone is in this case secured only at one end to the base 16 and is separated from the base 50 of the shot holder at its other end. The holder 48 has a stepped bore the larger portion of which is designed to receive the tracer element 26 with a loose fit. The stepped bore is closed at its smaller end and a series of tapered cross bores 54 are provided in the side wall of the holder and lead into the stepped bore adjacent the smaller end in like manner to the embodiment shown in FIGS. 4 and 5 of the drawings.

As in the embodiment shown in FIG. 2, the crush zone formed by the tubular section 52 comprises a series of resilient compression members which may be formed integrally with the base 16 by forming these components from a suitable plastics material. Similarly, the tracer holder 48 and shot holder 50 may also be formed integrally from a suitable plastics material.

On firing, the action of this cartridge is similar to the cartridge shown in FIG. 2 but when, because of the action of the flame/pressure front of the ignited propellant, the crush zone has compressed past the cross-bores 54, hot gases from the burning propellant enter these cross bores and, owing to the directional nature of these bores, the hot gases are directed onto the surface of the incendiary material 28 of the tracer element 26 to ignite said material. The spacing of the cross bores 54 from the end of the holder 48 is determined by the pressure achieved and the crushability of the crush zone.

Ejection of the wad and shot from the gun barrel is the same as in the embodiment shown in FIG. 2 as is the sealing of the tracer element on the shoulder of the stepped bore in the holder 48.

Figure 7:
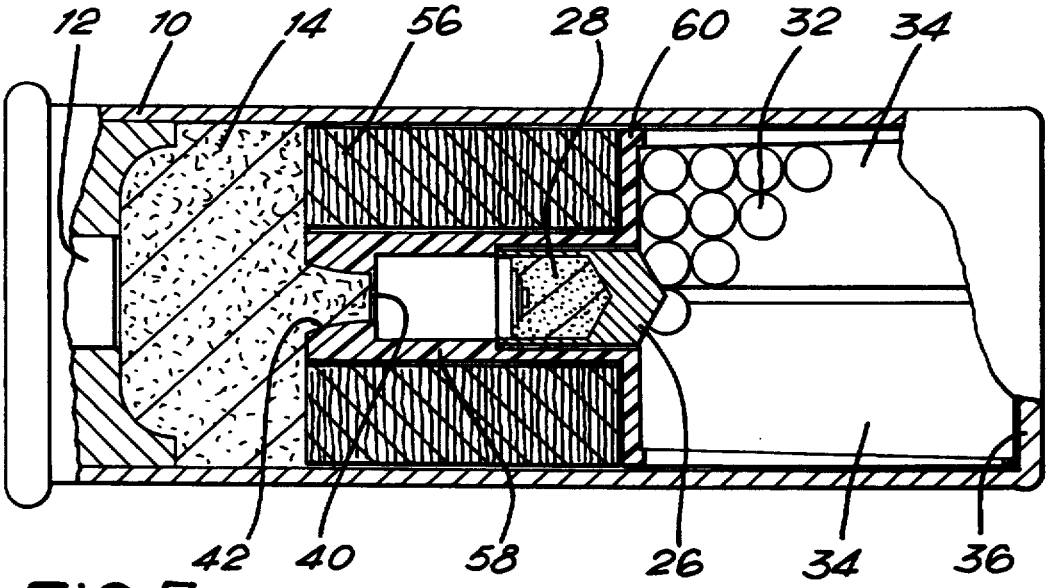
FIG. 7 is a longitudinal cross-sectional view of a tracer cartridge fitted with a further embodiment of a wad according to the invention.

The cartridge shown in FIG. 7 differs from the previous embodiments in that, in this case, the crush zone is formed by a soft, fibrous, tubular member 56 which is designed to be a fairly close fit over the tracer element holder 58. It will be seen that this holder is similar to the holder 38 shown in FIG. 3 of the drawings but is attached to the base 60 of the shot holder. In this embodiment the base 16 of the tracer wad is omitted.

On firing, the action of this cartridge is similar to the cartridges shown in FIGS. 2 and 6 but when the flame/-pressure front reaches the membrane 40, the membrane ruptures and the hot gases are directed by the funnel action of the tapered bore 42 onto the incendiary material 28 of the tracer element 26 to ignite this material. Ejection of the wad and shot from the gun barrel and sealing of the tracer element on the shoulder of the stepped bore of the holder 58 is the same as in the embodiments shown in FIGS. 2 and 6.

Figure 8:
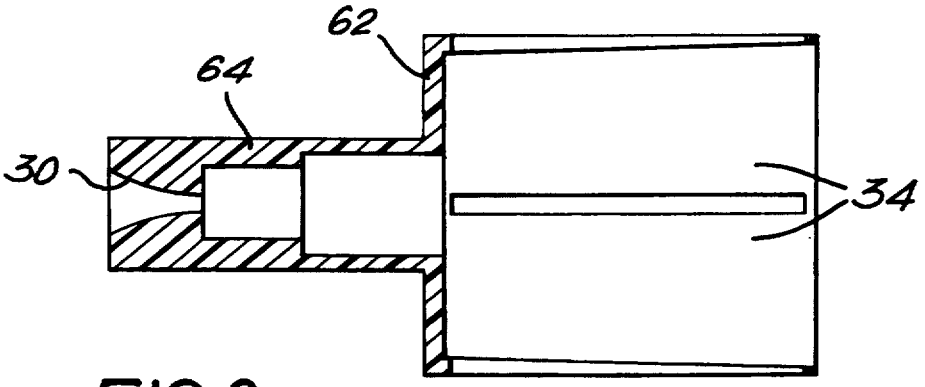
FIG. 8 is a longitudinal cross-sectional view of still another embodiment of a wad according to the invention.

FIG. 8 shows a further embodiment of a combined tracer element holder 62 and a shot holder having a base 62 to which the holder 64 is attached. The holder 64 is otherwise similar to the tracer element holder shown in FIG. 2 of the drawings. In both of the embodiments shown in FIGS. 7 and 8, the tracer element holder and shot holder may be formed integrally from a suitable plastics material.

Various combinations of tracer element holders, shot holders and crush zones are possible. Thus, for example, the tracer element holders shown in FIGS. 3 or 4 and 5 of the drawings may be used in the cartridge shown in FIG. 2, the tracer element holders shown in FIGS. 7 or 8 may be used in the cartridge shown in FIG. 6 and the tracer element holders shown in FIGS. 6 or 8 may be used in the cartridge shown in FIG. 7. The crush zone shown in FIG. 6 may be used in the cartridge shown in FIG. 7 and, equally, the crush zone shown in FIG. 7 may be used in the cartridge shown in FIG. 6. If the cap/propellant combination do not require a crush zone to work efficiently, the crush zones employed in the cartridges according to the invention may be made to be almost solid.

Figure 9:
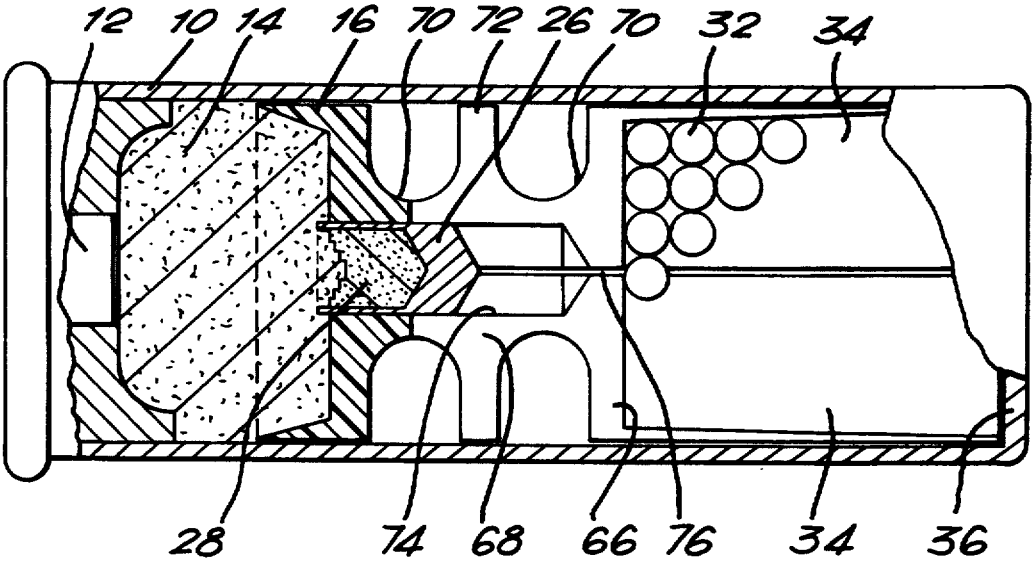
FIG. 9 is a longitudinal cross-sectional view of a tracer cartridge fitted with a still further embodiment of a wad according to the invention.

Reference will now be made to FIG. 9 of the drawings in which the tracer wad takes the form of a plastics moulding comprising a cup-shaped base 16 connected by a crush zone to the base 66 of a shot holder. The crush zone takes the form of a tubular member 68 in which a pair of deep grooves 70 are formed to define between them an annular ridge 72. The tubular member also has a closed bore 74 for receiving, at its open rear end, a tracer element 26 so that the tubular member also acts as a tracer element holder. The slots in the side wall of the shot holder which form the quadrants 34 are extended down into the tubular member 68, as shown at 76 in FIG. 9, and terminate just short of the tracer element.

The tracer element 26 is inserted into the bore 74 to such an extent that the surface of the incendiary material 28 coincides with the surface of the base 16 of the tracer wad. The fit between the tracer element 26 and the bore 74 is arranged to be such that, on ignition of the propellant charge 14, movement of the tracer element up the bore 74 will occur when pressure from the propellant is at an appropriate percentage of its maximum. This percentage can be ascertained from the co-efficient of friction between the tracer element and the material of the tubular member 68.

On being struck by a firing pin, the percussion cap 12 ignites the propellant charge 14 and a flame/pressure front progresses through the propellant as in the previous embodiments until it reaches the surface of the incendiary material 28 and ignites it. When the pressure from the propellant reaches a certain predetermined percentage of its full force, it pushes the tracer element forwards down the bore 74 until the element reaches the closed end of the bore. The crush zone is compressed and exerts a force through the base 66 of the shot holder and the shot 32 on the turnover 36 until the latter is peeled back and the wad and shot are ejected from the casing 10.

As with the previous embodiments, the shot is contained within the walls 34 of the shot holder until the wad exits from the gun barrel. The four arcs of the walls 34 are then peeled back by wind pressure to free the shot. In this case, however, the walls 34 are effectively extended to the bore 74 by the slots 76 so that the walls of the tubular member 68 are also peeled back to free the tracer element so that the latter is free to follow the trajectory of the shot. The extent of the slots 76 in the tubular member 68 is such that an effective gas seal is provided by the tracer element 26 while the wad is still in the barrel while still allowing the tracer member to break free from the wad on leaving the barrel.

Figure 10:
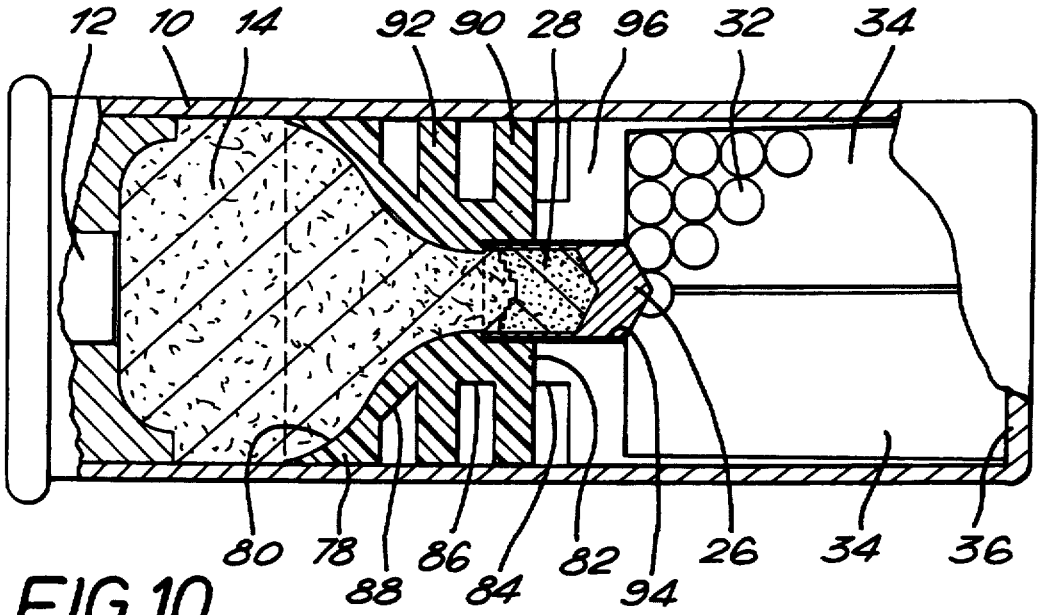
FIG. 10 is a longitudinal cross-sectional view of a tracer cartridge fitted with another embodiment of a wad according to the invention.

In the embodiment shown in FIG. 10 of the drawings, the tracer wad again takes the form of a plastics moulding forming an integral shot holder, tracer element holder and crush zone. In this case, the base 78 of the tracer wad has a profiled depression 80 the walls of which have a sinusoidal curve in cross-section and which extends into a tubular member 82 constituting the crush zone. A series of grooves 84, 86, 88 are formed in the outer wall of the tubular member 82 forming annular ribs or ridges 90, 92 between them. A bore 94 extends in the tubular member 82 from the bottom of the depression 80 to the base 96 of the shot holder for receiving the tracer element 26. The slots dividing the side walls 34 of the shot holder into quadrants extend through the base 96 and the area of the first groove 84 down to the rib 90 as shown in FIG. 10 of the drawings. The diameter of the bore 94 is greater than the bottom of the depression 80 and provides a step or shoulder for receiving the rear end of the tracer element 26.

On striking the percussion cap 12, the propellant charge 14 is ignited and the flame/pressure front is guided by the profiled side walls of the depression 80 onto the incendiary material 28 of the tracer element 26. The crush zone acts as before to exert a force on the turnover 36 until the latter is peeled back and the wad and shot are ejected from the casing 10. Once the wad exits from the barrel, the walls 34 are peeled back as with the above-described embodiments to free the shot. The quadrants of the base 96 of the shot holder and the leading ends of the tubular member 82 are also peeled back to free the tracer element and allow it to follow the trajectory of the shot.

The profiled walls of the depression 80 allow propellant to flow easily to the incendiary material 28 of the tracer element 26 during assembly of the cartridge.

Preferably, these walls are provided with a series of grooves or ribs to allow gas flow thus providing paths for hot gases to reach the surface of the incendiary material of the tracer element. In like manner, grooves or ribs may also be provided in or on the walls of the tapered bores 30 and/or 42 shown in FIGS. 2 and 8 and 3 and 7 respectively.

Figure 11:
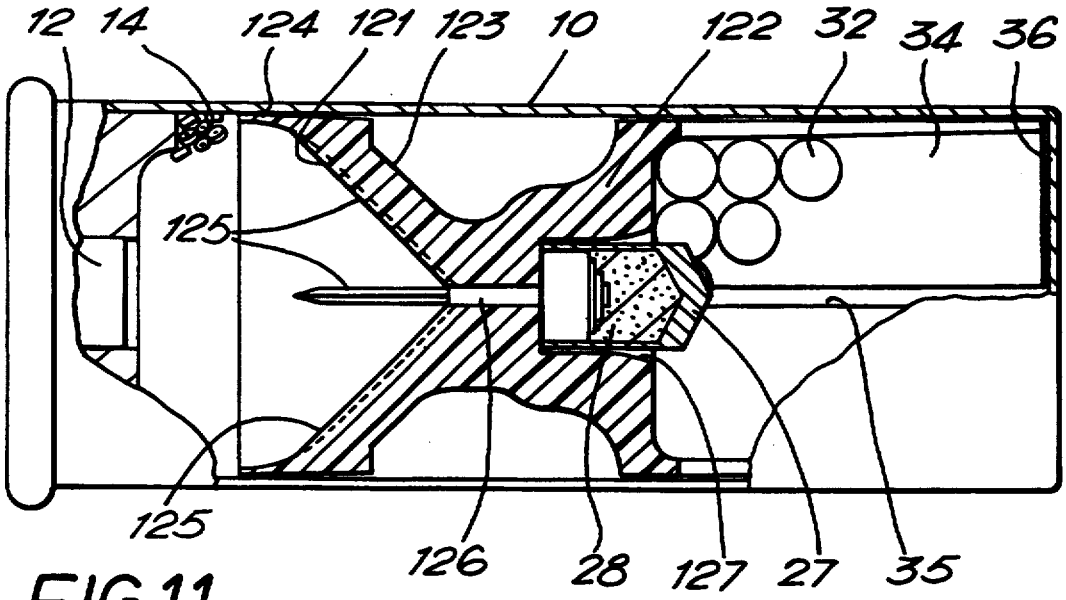
FIG. 11 is a longitudinal cross-sectional view of a tracer cartridge fitted with yet another embodiment of a wad according to the invention.

Reference will now be made to FIGS. 11 and 12 of the drawings in which the tracer wad again takes the form of a plastics moulding but in this case the rear of the wad is moulded in such a manner as to provide a conical recess 121. The rear of the wad is connected to the base 122 of a shot holder by a profiled crush zone 123 and tapers outwardly from having a diameter at the region adjacent to the crush zone which is substantially equal to the diameter of the base 122 to an increased diameter at the extreme rear end of the wad. The inner surface of the rear of the wad in which the conical recess 121 is formed merges towards the outer surface of the wad at the rear end to form a thin flexible skirt portion 124. The diameter of the skirt portion 124 is greater than the largest bore in the parallel section of a shotgun barrel for which the wad is intended but because the skirt portion is flexible, being thin and produced from a relatively soft plastics material, it is compressed and forms a good seal against the barrel wall as well as through the smallest choke.

A series of ridges 125 are formed on the surface of the conical recess 121 leading from its narrow end to adjacent the region at which the skirt portion 124 begins. A bore 126 leads from the narrower end of the conical recess 121 to a larger bore 127 which is formed in the base 122 and which constitutes a tracer element holder adapted to receive a tracer element 27. The bore 127 is desirably tapered towards its outer end to ease exit of the tracer element from the wad when the cartridge is fired.

When the wad is inserted into the cartridge casing 10, after insertion of the propellant charge 14, the propellant is funnelled into the conical recess 121 until packed to the designated density. The tracer element 27 is inserted into the bore 127 after which the lead shot 32 is inserted into the wad holder formed by the walls 34 and the casing is turned over at 36 as in the previous embodiments above described. On being struck by a firing pin, the percussion cap 12 ignites the propellant 14 and a flame/pressure front passes through the propellant converting it to pressurised hot gas. When the flame front reaches the ridges 125, the flame passes down the ridges. This is because the propellant, which may take the form of grains, flakes, granules, discs or spheres (hereinafter called "grains"), does not form a good seal against the ridges and the flame, under pressure, passes down the minute gaps caused by this poor seal. This creates a situation where the propellant is ignited at the bore 126 sooner than would occur without the ridges and before the peak pressure is reached in the cartridge. Thus, ample hot gas under pressure is available to impinge on the tracer composition 28 and ignite it. The diameter of the bore 126 is small enough to prevent the passage of individual grains of propellant but large enough to allow the passage of sufficient hot gas to ignite the tracer composition.

As pressure builds up in the cartridge, the wad and the lead shot 32 move forward and turn back the turnover 36 releasing the wad which, with the shot, is accelerated down the barrel. This acceleration, plus the acceleration of the lead shot against the tracer element, forces the latter against the closed end of the bore 127 creating an effective gas seal. This prevents gas leakage past the tracer element into the lead shot. The skirt portion 124 also provides effective sealing of the wad in the barrel and prevents gas leakage past the wad. This is important because, if there is a gas leakage, the internal ballistics and consequently the muzzle velocity of the wad, shot and tracer element can be adversely affected.

On exit from the barrel, the wad, shot and tracer element are travelling at high velocity. At this high velocity, the arcs 34 catch the air and are peeled back. Because the wad is made of a lightweight plastics material, with high area to mass ratio, it decelerates rapidly leaving the lead shot to continue. The bore 127, in which the tracer element 27 is located, is central to the wad and is a loose fit. On deceleration of the wad, the element slips easily from the bore 127 and follows the shot central to it. The mass of the tracer element 27 is adjusted to ensure that the tracer element remains at the centre of the spreading circle of the lead shot and in a consistent position in the longitudinal spread of the shot. This longitudinal spread is known as the "string".

The wad shown in FIGS. 13 to 15 differs from the wad shown in FIGS. 11 and 12 in that the narrower end of the conical recess 121 is closed by a diaphragm 128 and a bore 129, which has a larger diameter than the bore 126, leads from the diaphragm to the bore 127. The strength of the diaphragm 128 is determined by variation of its thickness and the diameter of the bore 129 to cater for variations in the propellant used and of the material from which the wad is moulded. The optimum burst point is a point on the upward side of the pressure/time curve of the propellant used. Thus, when the flame front travels down the ridges 125, it is effective to burst the diaphragm 128 and travel along the bore 129 to impinge on the surface of the tracer element and ignite it. The provision of the diaphragm means that the bore 129 can have a larger diameter than the bore 126 without the fear of propellant grains entering the bore.

Although both the bores 126 and 129 are shown as having parallel sides, this is not essential and either bore could be tapered or profiled provided that the conditions of grain passage prevention and sufficient hot gas passage referred to above are met. Further, the bore 127 for holding the tracer element 27 need not necessarily be partly parallel-sided and partly tapered as shown in FIGS. 11 and 13. The bore could be totally parallel-sided or completely tapered or profiled or a combination of any of them. What is important is that the bore 127 should keep the tracer element 27 central in the wad and that it should be oversize in relation to the element so that the element is free to release itself from the wad on exit from the barrel. The element stays essentially central to the shot in the barrel and is therefore central to it on exit.

Instead of providing ridges 125 on the surface of the conical recess 121, grooves 125 prime of FIG. 15A may be provided in this surface instead. It has been found that the poor seal between the propellant grains and ridges occurs in like manner when grooves are provided instead of ridges. Moreover, although four ridges are shown in the drawings, more or less ridges or grooves may be provided if desired. Further, the ridges or grooves do not need to extend throughout the entire length of the conical recess 121.

FIG. 16 shows a modification of the tracer wad shown in FIG. 11 in which slots 35 in the slot holder, which create the arcs 34, are extended by narrower slots 37 into the bore 127 and extend almost to the closed end of this bore. The diameter of the bore 127 is such that the tracer element 27 is a slight interference fit in the bore. In this way, when the tracer element is assembled to the wad, a load is required in order to insert the element to the bottom of the bore 127. The natural resilience of the plastics material from which the wad is moulded will hold the tracer element in place so that the tracer element and wad can be transported as a sub-assembly for subsequent insertion in a cartridge casing. On exit from the barrel when the assembled cartridge is fired, the arcs 34 will peel back to release the tracer element which can then follow the shot.

The slots 35 in the embodiment of the wad shown in FIGS. 13 to 15 may be similarly extended if desired.

FIGS. 17 and 18 show two methods of production of tracer elements and their respective methods of trajectory adjustment. This adjustment is necessary because for the same muzzle velocity, different lead shot sizes will have different trajectories. The tracer element 27 shown in FIG. 17 is produced from a metal, for example brass, copper, steel or zinc, where the overall weight can be adjusted by changing dimension 'x' but by leaving all other dimensions unchanged. This will change its mass, and therefore its drag coefficient, and therefore its trajectory through the air given the same initial velocity. It follows then that the tracer element 27 can have its trajectory matched to the lead shot. The tracer element 131 shown in FIG. 18 is moulded in a plastics material and is ballasted by the insertion of a plug 132 which can be, for example, lead, copper or steel, and the amount varied by adjustment of 'y'. Thus the mass of this tracer element can be changed to meet the required trajectory. The front profiles in both FIGS. 17 and 18 are shown to be conical, but could be hemispherical or parabolic.

FIG. 19 shows a modification of the tracer element shown in FIG. 17 in which the rear end edge of the tracer element is turned in to form a curved wall 133. This will reduce the tendency of the thin metal wall of the tracer element to cut into the soft plastics material of the tracer wad. Such cutting in would restrict the release of the element from the wad on exit from the barrel of a firearm when a cartridge fitted with a tracer wad according to the invention is fired. The curved wall 133 serves another function in that, the diameter of the opening defined by the wall 133 being less than the diameter of the tracer element, the flow of gas emanating from the burning incendiary composition 28 builds up pressure at the burning surface which helps to sustain burning of the composition.

The burning time of the tracer elements 26, 27 and 131 can be adjusted by varying the amount of incendiary material 28 which is loaded into the elements.

The tracer wads according to the invention may be used in cartridges intended for any suitable firearms although they are primarily intended for use with 12 bore and 16 bore shotgun cartridges.

Any or all of the tracer wads described and illustrated in the foregoing may be sold as separate items, with or without a tracer element 26, 27 or 131, or may be sold assembled in a cartridge. If the tracer wad is sold as a separate item, it may be handled in much the same way as an ordinary wad. Thus, a shooter may purchase a ready made tracered cartridge or a tracer wad with or without a tracer element to load his own cartridges.

As will be apparent to those skilled in the art, in all of the above-described embodiments, once the wad has left the barrel, the tracer element breaks free without interference and the wad itself can fall to the ground without affecting or impeding in any way the tracer element which is free to follow the trajectory of the shot.

By varying the mass of the tracer element, it is possible to substantially ballistically match the tracer element to the shot 32 by varying the overall mass to frontal area so that the tracer element will substantially follow the trajectory of the shot 32. A firer may then observe the path of the burning tracer element and, essentially, the centre of the spread of the shot 32.

The present invention provides a wad with a self-contained tracer element which can be handled and assembled as any other wad, does not interfere with the volume designated for the shot, which when filled to a cartridge and said cartridge is fired, holds the tracer element centrally in the barrel and on exit from the barrel allows release from the wad without the wad exerting any influence on the subsequent trajectory thus allowing the tracer element to follow the shot.

The invention also provides reliable ignition of a tracer element in a plastics wad which it was not heretofore possible to achieve. It also ensures a good gas seal between the tracer element and the wad and the latter provides a good gas seal throughout the barrel length with no difficulty passing through the smallest choke.

The invention is not restricted to the above-described embodiments but modifications and variations are possible without departing from the scope of the invention. For example, if desired, the tubular member 82 of the tracer wad shown in FIG. 10 may be provided with a diaphragm or membrane similar to the membrane 40 shown in FIG. 3 of the drawings.

I claim:

1. A one piece tracer wad for a cartridge, said one piece tracer wad comprising a shot holder, a tracer element holder and means for directing ignited propellant onto a tracer element held in said tracer element holder for ensuring reliable ignition of the tracer element on firing of the cartridge, said tracer element holder being adapted to hold a tracer element in a releasable manner whereby the tracer element is released when said tracer wad leaves the barrel of a firearm on firing of the cartridge, wherein said means for directing ignited propellant onto a tracer element held in said tracer element holder comprises a conical recess formed in an end of said tracer wad which is remote from the shot holder and one or more axially aligned ridges in a surface of said conical recess.

2. A one piece tracer wad according to claim 1, wherein the narrow end of said conical recess communicates with said tracer element holder via a small bore formed in said tracer wad.

3. A one piece tracer wad according to claim 2, wherein the bore is closed by a frangible diaphragm which is designed to rupture when a cartridge containing the tracer wad is fired.

4. A one piece tracer wad according to claim 1, wherein the end of said tracer wad remote from said shot holder is provided with a flexible skirt portion which is engageable with the barrel of a firearm during firing to provide a gas seal and prevent the escape of gas past said one piece tracer wad.

5. A one piece tracer wad according to claim 4, wherein said skirt portion is connected to said shot holder of said tracer wad by a crush zone.

6. A one piece tracer wad according to claim 1, wherein said tracer wad includes a crush zone located around said tracer element holder.

7. A one piece tracer wad according to claim 1, wherein said shot holder has a side wall which is divided by slots into quadrants.

8. A one piece tracer wad according to claim 7, wherein the slots extend down into the tracer element holder.

9. A one piece tracer wad according to claim 1, wherein said tracer wad includes a crush zone formed integrally with said tracer element holder.

10. A one piece tracer wad for a cartridge, said one piece tracer wad comprising a shot holder, a tracer element holder and means for directing ignited propellant onto a tracer element held in said tracer element holder for ensuring reliable ignition of the tracer element on firing of the cartridge, said tracer element holder being adapted to hold a tracer element in a releasable manner whereby the tracer element is released when said tracer wad leaves the barrel of a firearm on firing of the cartridge, wherein said means for directing ignited propellant onto a tracer element held in said tracer element holder comprises a conical recess formed in an end of said tracer wad which is remote from the shot holder and one or more axially aligned grooves in a surface of said conical recess.

11. A one piece tracer wad according to claim 10, wherein the narrow end of said conical recess communicates with said tracer element holder via a small bore formed in said one piece tracer wad.

12. A one piece tracer wad according to claim 10, wherein the end of said tracer wad remote from said shot holder is provided with a flexible skirt portion adapted to engage the barrel of a firearm during firing to provide a gas seal and prevent the escape of gas past said one piece tracer wad.

13. A one piece tracer wad according to claim 12, wherein said skirt portion is connected to said shot holder of said tracer wad by a crush zone.

14. A one piece tracer wad according to claim 9, wherein said shot holder has a side wall which is divided by slots into quadrants.

* * * * *